United States Patent [19]

Story et al.

[11] Patent Number: 4,936,128

[45] Date of Patent: Jun. 26, 1990

[54] CONTROL OF CAVITATION IN SUPERPLASTIC FORMING THROUGH USE OF ACOUSTIC EMISSION

[75] Inventors: James M. Story, Pittsburgh, Pa.; David Dornfeld, Berkeley, Calif.

[73] Assignee: Aluminum Company of America, Pittsburgh, Pa.

[21] Appl. No.: 444,437

[22] Filed: Dec. 1, 1989

[51] Int. Cl.[5] ..... B21D 26/02

[52] U.S. Cl. ..... 72/60; 72/54; 72/709; 29/421.1

[58] Field of Search ..... 72/38, 54, 56, 58, 60, 72/63, 709, 342, 364; 29/421.1

[56] References Cited

U.S. PATENT DOCUMENTS

| | | | |
|---|---|---|---|
| 4,181,000 | 1/1980 | Hamilton et al. | 72/60 |
| 4,233,831 | 11/1980 | Hamilton et al. | 72/60 |
| 4,288,021 | 9/1981 | Leodolter | 72/60 |
| 4,352,280 | 10/1982 | Ghosh | 72/60 |
| 4,354,369 | 10/1982 | Hamilton | 72/60 |
| 4,516,419 | 5/1985 | Agranal | 72/60 |
| 4,708,008 | 11/1987 | Yasui et al. | 72/60 |
| 4,713,953 | 12/1987 | Yavari | 72/60 |

*Primary Examiner*—David Jones

*Attorney, Agent, or Firm*—Elroy Strickland

[57] ABSTRACT

A method of superplastically forming a part from a blank of material. The blank is placed between opposed die structures and heated to a superplastic forming temperature. Positive fluid pressure is supplied at an increasing rate against a front surface of a blank to stretch the same into a cavity of one of the dies to begin formation of the part. A positive fluid pressure is also applied against the back surface of the blank, and acoustical energy emitted by the material of blank resulting from the occurrence of cavitation in the material is sensed. The sensing of acoustical energy is employed to control one or more of the above parameters until the formation of the cavities substantially reduces or ceases altogether.

10 Claims, 1 Drawing Sheet

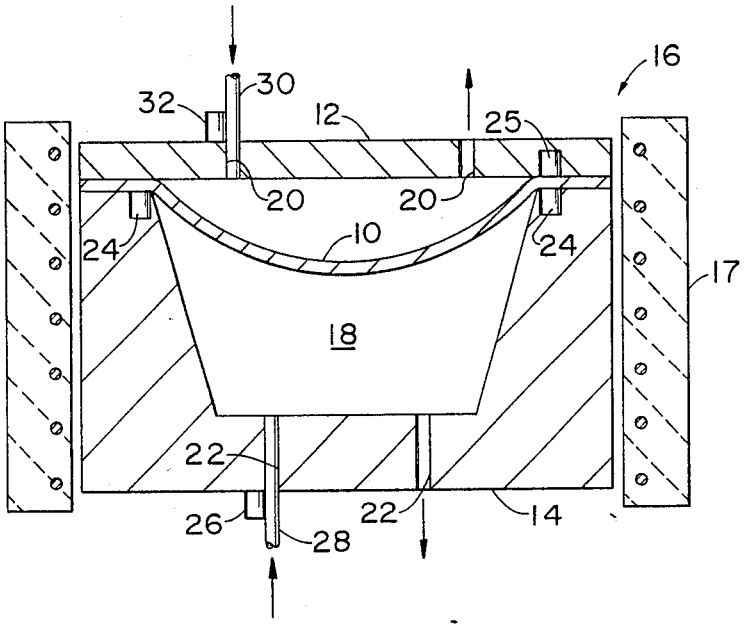
16
30
32
12
25
20
20
10
24
24
17
18
22
22
14
26
28

CONTROL OF CAVITATION IN SUPERPLASTIC FORMING THROUGH USE OF ACOUSTIC EMISSION

BACKGROUND OF THE INVENTION

The present invention relates generally to superplastic forming, and particularly to the control and prevention of the formation of cavities in superplastically formed parts by sensing the onset of acoustical emissions caused by cavity formation.

One possible mechanism for the formation of voids or cavities is that, as one grain of a material slides past another grain during a forming process, a void may form along the boundary between the grains, frequently at the intersection of three grains. The void is eliminated if adjacent material diffuses into the void to fill the same.

U.S. Pat. Nos. 4,354,369 and 4,516,419 to respectively Hamilton and Agrawal show methods for reducing and preventing the formation of cavities or voids in metal parts formed by superplastic forming. Hamilton, for example, employs pressure to both sides of a blank workpiece either during the forming or after completion of forming. If applied during forming, the pressure reduces the magnitude of the tensile hydrostatic or mean stress acting on sites of cavity nucleation, thus preventing the formation of voids or at least decreasing the size to which they grow and/or the number of voids. The imposition of pressure to both sides of the blank adds a compressive hydrostatic stress component to the normally generated tensile hydrostatic stress to provide a net hydrostatic component of reduced tension or even a compression. Cavitation is thereby reduced or eliminated because forming is accomplished while the voids or void nucleation sites are subjected to reduced tensile stresses.

Similarly, Agrawal applies fluid pressure on both sides of a blank in a superplastic forming process such that the opposing pressures suppress or eliminate cavitation and thereby reduce chances of rupturing of the blank while it is being formed into a component part. Agrawal notes that the elimination or substantial reduction of cavities is essential to enhance tensile elongation and to ensure desirable properties in the product so formed. As in the above Hamilton patent, Agrawal, in using high pressures on both sides of the blank at the beginning of the forming cycle, provides compressive stress over the entire blank of material to suppress initiation of cavities. In addition, a high pressure maintained on the side of the part opposite the forming surface of the die after completion of forming also provides a similar compressive stress over the entire part to affect closure of cavities that may still remain in the part.

Another publication disclosing the use of back pressure to control cavitation during superplastic forming is a paper entitled "Forming Process Variable Effects on Cavitation in the Superplastic Forming of Commercially Produced 7475 Aluminum" by J. M. Story, J. I. Petit, D. J. Lege and B. L. Hazard, as published in Superplacity in Aerospace-Aluminum, Cranfield, United Kingdom, edited by Roger Pearce and Larry Kelly, 1985. J. M. Story is one of the inventors of the present application. This article, inter alia, provides time-temperature profiles and other data for superplastically forming 7475 aluminum alloy pans. The disclosure of this article is incorporated herein by reference.

Presently, mathematical models are employed to predict the rate of pressurization that is necessary to maintain a constant true effective strain rate to provide maximum superplastic formability and minimum cavitation. Such models are disclosed in U.S. Pat. 4,181,000 and 4,233,831 to Hamilton et al, and in 4,713,953 to Yavari, for example. Models that have proven practical in the industry are limited to plane strain and axisymmetric forming. Nonsymmetrical parts are analyzed on a regional basis, treating local regions as plane strain or axisymmetric.

BRIEF SUMMARY OF THE INVENTION

The present invention is directed to a method of controlling cavitation in superplastic forming that eliminates the need for mathematical models in developing SPF forming cycles. (Such models, however, can be used to predict strain distributions in the part that will result when a part of a given geometry is formed.) The present method employs at least one acoustical sensor located near the part being formed, and preferably in the tooling for forming the part, to sense the onset of cavitation. When a void or a cavity starts to be formed in the part, the forming of the void emits sonic energy that can be detected by the sensor.

The part is formed from a blank of material subjected to a forward application of pressure to one side of the blank that forces the blank into and onto (depending upon the interior configuration of a female die) a female die surface that provides the part with the desired configuration. When acoustic energy is sensed, at least one of the forming parameters, which include forward and back pressure, the rate at which the forward pressure is applied, and the temperature of the part being formed, is changed until formation of the cavities is reduced substantially. The ultimate reduction is when cavitation ceases altogether. When back pressure is the variable controlled, if cavitation is sensed after increases in back pressure require clamping loads approaching the clamping capacity of the press, the method includes reducing the rate of increase in the front pressure until cavities cease to initiate and grow. The reason that cavitation decreases with a decrease in pressurization rate is that the resulting reduced forming rate allows time for an adjacent material to diffuse into the void area. This latter approach provides a maximum rate of pressurization to be used, which will not result in cavitation thereby minimizing forming time, and problems involving structural performance of the finished part caused by cavitation are reduced if not eliminated altogether.

It is known that materials undergoing deformation produce acoustic emissions. Such emissions are defined as the transient elastic energy spontaneously released in materials and are dependent upon the basic deformation mechanisms such as dislocation motion, grain boundary sliding, twinning, and vacancy coalescence. This is discussed in an article by David Dornfeld, the other inventor of the subject application, in the published proceedings of the Eighth North American Manufacturing Research Conference that took place in May, 1980 in Rolla, Mo., pages 207–213. These proceedings, however, do not discuss the phenomena of cavitation in superplastic forming and the need to control the same in order to produce structural components having appropriate toughness and high strength properties.

As discussed above, what is needed in the art of superplastic forming is the ability to detect cavitation, and particularly the beginnings of cavitation and proceed to order the steps of the process in a manner that reduces and eliminates the cavities while simultaneously keeping forming time to a minimum.

THE DRAWING

The advantages and objectives of the invention will be best understood from consideration of the following detailed description and the accompanying drawing, the sole figure of which is a cross sectional view of a die and sensor combination for effecting and controlling a superplastic forming process.

PREFERRED EMBODIMENTS

As shown somewhat diagrammatically in the figure of the drawing, a blank of material 10 is clamped between an upper die or plate 12 and lower female die 14 of a press 16, and heated by heating means 17 to a temperature range in which the blank exhibits superplastic characteristics. The blank is then expanded and stretched into the cavity 18 by the force of a forming fluid directed under pressure into the cavity. The forming fluid enters in the cavity through an opening or port 20 provided in the upper die wall or plate 12 from a source of the fluid (not shown) and is generally removed via a second opening (bearing the same numeral). The pressure of the fluid, rather than the flow itself, stretches the blank into cavity 18. The blank is formed into a final part (not shown) that conforms generally to the internal shape of cavity 18 of the lower female die. The forming pressure is known as "forward or front pressure", and "back pressure" is that pressure applied against the downwardly facing surface of blank 10 (in the figure) and thus against the force of the forward pressure. Back pressure can be applied through ports 22 provided in the lower die in the manner of that of the forward or front pressure.

As explained, for example, in the above Agrawal patent, cavitation occurs during superplastic deformation of a blank. Cavitation is a phenomenon which generally arises under the combined action of tensile stress and grain boundary sliding of the grains of the material of the blank, as explained earlier. Both of these conditions exist during the superplastic forming process. When one grain slides past another grain, a void may be generated along the boundary between grains. Other nearby grains lie adjacent to the boundary. If an "accommodation event" occurs that forces material from an adjacent grain or at least a part thereof to diffuse into the cavity, the cavity is filled. Ordinarily, triple-grain junctions or triple points are the usual sites for cavities. Cavities, however, may also be observed at other locations on grain boundaries or at second phase particles.

If the onset of cavitation formation is detected, the process variables in superplastically forming a part can be quickly adjusted to discourage the cavity formation. As discussed earlier, such detection allows a maximum rate of pressurization and a minimum of forming time so that the production of parts is not slowed.

For many part geometries, at some point during the SPF cycle, pressure will be reduced for some period of time, generally followed by a second period of increasing pressure at the end of the operation. This is necessary to maintain a constant strain rate in the blank, as the blank takes on different configurations in moving into the die cavity in the process of assuming the final configuration of the surfaces of the cavity. The term "maximum pressurization rate" used in this disclosure means to use a pressure-time schedule resulting in the least forming time not yielding cavitation.

The onset of cavity formation emits acoustical energy of a character peculiar to cavity formation, which is detectable by an appropriate sonic energy sensor (transducer). The particularity of the emitted energy distinguishes it from dislocation motion and particle cracking, for example.

As shown in the figure of the drawing, the occurrence of detectable sonic energy (acoustical emission) representative of the onset of the cavitation occurring in blank 10 is sensed by sensors 24 located in the wall of female die 14 and preferably in physical contact with the periphery of the blank clamped between dies 12 and 14. A similar sensor 25 (or sensors) can be located in die plate 12. The acoustical activity is generally not of sufficient amplitude to travel long distances in open spaces. Hence, sensors 24 and 25 are positioned as close to the die-work interface as possible. The acoustical energy does travel efficiently through the solid material of the blank such that it easily reaches the location of sensors 24 and 25.

Most liquids are good conductors of acoustical energy such that if cavity 18 if filled with such a liquid, coupling of the energy to ports 22 and a sensor 26, as shown in the figure, located against a conduit 28 containing the liquid, allows detection of cavities occurring in the blank. A second detector (not shown) can be located adjacent the other port 22.

Further, if a liquid is contained between blank 10 and upper die plate 12 and in a conduit 30, a sensor 32 can be located adjacent entry port 20 and conduit 30.

The movement of liquids often has some turbulance associated therewith, depending upon the rate of flow and characteristics of orifices, such that it is best to avoid locating the sensors near areas of turbulance. This will minimize background noise in the process of detecting the formation of cavities.

Heat resistant acoustical sensors are available such that they can be located in the dies of press 16, or on outer die surfaces, as discussed above, without being harmed by the heat of the dies that is employed to heat blank 10 to a superplastic temperature. In addition, heat sinks and/or wave guide extensions can be used to isolate and protect the sensors if the sensors are not sufficiently heat resistant.

Hence, in the present process, a blank 10 to be formed into a part is located between the dies of apparatus 16 and a forming medium is directed through opening 20 in die 12 at a forward pressure sufficient to form the blank into the part after the blank is heated to a temperature at which it exhibits superplasticity. Back pressure is applied to the blank though exhaust ports 22 of die 14 so that the material of the blank is under compression. The forward pressure is greater than the back pressure so that the blank can be moved into die 14 from blank 10 to form the part. The forward pressure forces the blank into cavity 18 of the lower die at a rate of pressure increases that maintains a proper strain rate in the material of blank 10 to provide maximum formability with minimum cavitation. A typical rate of increase can be on the order of five to ten psi per minute. At least one sound sensitive transducer is located to sense the onset of any cavitation that may occur by sensing the acoustic energy emitted from the formation of voids or cavities. The transducer produces an electrical output that is sent either to a meter or other indicating device for use by a workman to control pressurization in the forming process, or the output can be sent to a computer or other electrical device for automatically controlling the rates of pressurization in the sequence of operation, as presently to be explained.

When the onset of cavitation is first sensed by the sensor or sensors, back pressure can be incrementally increased against blank 10 to suppress the cavities, as described in the above U.S. patents to Hamilton and Agrawal. In the case of the 7475 aluminum alloy pan maintained at 516° C., as discussed in the above Story et al article, and using a back pressure of 150 psi, as disclosed, increments of say twenty-five psi are repeatedly made until cavitation in the alloy blank ceases.

If the back pressure is increased until the capacity of restraining devices (not shown) that keep dies 12 and 14 closed and sealed against the periphery of blank 10 is approached, such that keeping the dies closed and sealed (to retain pressure within the dies) becomes difficult, and cavitation is still being sensed by the sensors, and thus not fully suppressed, the rate of forward pressurization is reduced until cavities cease to initiate and grow. By reducing the rate at which the part is being formed in the dies, sufficient time is provided for diffusion of adjacent material into cavity areas to thereby eliminate the existence of the cavities in the material. The effect of the reduction in rate is documented in the above Story et al paper.

Or, using a constant back pressure of say 400 psi the forming rate of the forward pressure can be adjusted, when cavitation is sensed, to obtain the fastest possible forming rate, and hence attain the least total forming time that will not result in cavitation at a given back pressure.

In any case, a maximum rate of pressurization can be used, which minimizes forming time, though for many part geometries, as discussed earlier, pressure is reduced at some point in the forming cycle, and followed by a period of increasing pressure. This provides the benefits of increased rates of production while simultaneously providing a finished part that is structurally sound, i.e., one without voids and cavities.

Another of the forming parameters that can be controlled and changed upon sensing of acoustical emissions from the blank is that of the temperature of the blank. An elevated temperature reduces the flow stress in the blank, allowing the beneficial effects of back pressure to be obtained at a lower value, since the amount of back pressure needed to suppress cavities is a function of flow stress, as discussed in the Story et al paper.

Because of the control available through the sensing of cavitation, mathematical models are now not required to predict pressurization rates necessary to maintain a proper strain rate for maximum formability with minimum cavitation. And since these models are most practical for non-complex parts, as discussed above, nonsymmetrical, complex parts can be formed without the introduction of simplification errors, i.e., the transducer(s) (24, 25, 26 and/or 32) are always available to sense acoustical energy from the entire blank and part for areas in which cavitation may be occurring. In the present invention, therefore, the models are needed only to predict those strains which will result when a given part geometry is formed.

While the invention has been described in terms of preferred embodiments, the claims appended hereto are intended to encompass all embodiments which fall within the spirit of the invention.

What is claimed is:

1. A method of forming a part from a blank of material in which the blank is disposed between opposing die structures, heated to a temperature range in which the blank exhibits superplastic characteristics and formed into a part by the application of a first fluid pressure against one side of the blank at a rate that minimizes the formation of cavities in the material of the blank and part while a second fluid pressure of an amount less than the first fluid pressure is applied against the other side of the blank, the improvement comprising:

sensing acoustic energy emitted by the onset of cavitation with the material of the blank, and changing at least one of the above parameters until said cavitation in the material substantially reduces.

2. The method of claim 1 in which the rate at which the first fluid pressure is applied to the blank is changed until cavitation is substantially reduced.

3. The method of claim 1 in which the rate at which the first fluid pressure is applied to the blank is decreased until cavitation is substantially reduced.

4. The method of claim 1 in which the second fluid pressure is increased until cavitation is substantially reduced.

5. The method of claim 1 in which the temperature of the blank is changed to effect the substantial reduction in cavitation.

6. A method of forming a part from a blank of material in which the blank is disposed between opposing die structures, heated to a temperature range in which the blank exhibits superplastic characteristics and formed into a part by the application of fluid pressure against the front of the blank while fluid pressure of an amount less than the front pressure is applied against the back of the blank, the improvement comprising:

sensing acoustic energy emitted by the material of the blank and part that results from cavitation occurring in the material during forming, and changing at least one of the parameters at which the part is formed until the formation of cavities in the material substantially reduces, said parameters selected from the group consisting of the front and back pressure, the temperature of the blank and the rate at which the part is formed.

7. A method of superplastically forming a part from a blank of material comprising:

placing a blank of material between opposing die structures and over a forming surface provided in at least one of the die structures, heating the blank to a superplastic forming temperature, applying a positive fluid pressure at an increasing rate against a front surface of the blank to stretch the blank toward the forming surface to begin formation of a part from the blank, imposing a positive fluid pressure against a back surface of the blank, sensing sound energy emitted by the material of the blank that results from the occurrence of cavitation in the material, incrementally increasing back pressure on the blank when the sound energy is first sensed until the formation of cavities in the material of the blank substantially reduces or ceases altogether, and if cavitation is still being sensed after several incremental increases in back pressure, reducing the rate of the increase in front pressure until cavities cease to initiate and grow in the material of the blank.

8. Apparatus for superplastically forming a part from a blank of material, comprising:

opposing die structures for securing a peripheral portion of the blank between the die structures, means for heating the blank to a superplastic forming temperature, means for applying front and back pressure against the blank, and means for sensing sound energy that results from the formation of cavities in the material of the blank during the process of forming the part from the blank.

9. The apparatus of claim 8 in which the sensing means is located adjacent the peripheral portion of the blank.

10. The apparatus of claim 8 in which the sensing means is located adjacent the means for applying front or back pressure against the blank, with a liquid material being located in contact with said means for applying pressure, said blank and liquid material being effective to conduct acoustical emissions emanating from within the blank to the sensing means.

* * * * *